US009849069B1

(12) United States Patent
Khatri

(10) Patent No.: US 9,849,069 B1
(45) Date of Patent: Dec. 26, 2017

(54) PUSH OPERATED SINGLE PILL DISPENSER

(71) Applicant: Jayesh Khatri, Orlando, FL (US)

(72) Inventor: Jayesh Khatri, Orlando, FL (US)

( * ) Notice: Subject to any disclaimer, the term of this patent is extended or adjusted under 35 U.S.C. 154(b) by 0 days.

(21) Appl. No.: 15/299,450

(22) Filed: Oct. 20, 2016

(51) Int. Cl.
*A61J 7/00* (2006.01)
*B65D 83/04* (2006.01)

(52) U.S. Cl.
CPC ..... *A61J 7/0046* (2013.01); *B65D 83/0409* (2013.01)

(58) Field of Classification Search
CPC .... A61J 7/02; A61J 7/04; A61J 7/0409; A61J 7/0436; A61J 7/0454; A61J 7/0418; A61J 7/0445; A61J 7/0481; B65D 83/00; B65D 83/0481; B65D 83/0409; B65D 83/04
See application file for complete search history.

(56) References Cited

U.S. PATENT DOCUMENTS 3,601,250 A * 8/1971 Merila ..... B65D 83/0481 206/540
3,638,830 A * 2/1972 Belokin, Jr. ..... B65D 83/0409 206/533
3,871,522 A * 3/1975 Feldman ..... B65D 43/20 206/540
5,566,857 A * 10/1996 Rothman ..... B65D 83/0418 221/229
5,791,515 A * 8/1998 Khan ..... B65D 83/0409 206/533
8,727,180 B2 * 5/2014 Zonana ..... B65D 83/0409 221/195
9,730,860 B2 * 8/2017 Hamilton ..... A61J 7/04
2001/0028308 A1 * 10/2001 De La Huerga .. A61M 5/14212 340/573.1
2009/0283538 A1 * 11/2009 Collins ..... A61J 7/02 221/1
2012/0103985 A1 * 5/2012 Dwork ..... B65D 83/0481 220/254.1
2014/0332494 A1 * 11/2014 Balakier ..... A61J 7/04 215/365
2015/0021349 A1 * 1/2015 Sanders ..... A61J 1/03 221/1
2015/0342830 A1 * 12/2015 Bujalski ..... A61J 7/0076 221/1

* cited by examiner

*Primary Examiner* — Ayodeji Ojofeitimi
(74) *Attorney, Agent, or Firm* — The Patent Guild; Paul Royal, Jr.

(57) ABSTRACT

A push operated single pill, tablet, capsule, or other object dispenser that dispenses a single object at the push of a button.

12 Claims, 12 Drawing Sheets

PUSH OPERATED SINGLE PILL DISPENSER

CROSS-REFERENCE TO RELATED APPLICATIONS

None.

STATEMENT REGARDING FEDERALLY SPONSORED RESEARCH OR DEVELOPMENT

None.

BACKGROUND OF THE INVENTION

Field of the Invention

The present invention relates to a push operated pill, tablet, capsule, or other object dispenser that dispenses a single object at the push of a button.

BRIEF SUMMARY OF THE INVENTION

It is an object of the present dispenser to provide a push operated single pill tablet, capsule, or other object dispenser that dispenses a single object at the push of a button.

The present dispenser conveniently dispenses objects directly into the hand/palm of a user one at a time.

Further the present dispenser saves users' time in opening the bottle top and taking a single pill by preventing extra pills from coming out. Where more than a single pill comes out of the dispenser the user would then have to take the extra steps of putting the extra pills back into the bottle and touching the extra pills. Further the user may lose the extra pills which unintentionally spill out of other dispenser.

The present dispenser is particularly useful for users with stiff fingers or physical limitations which make it difficult to pick up unintentionally dispensed pills.

The present dispenser is removably or permanently attachable to a container, such as a bottle, tube, box, or encasement which is suitable for holding one or more object to be dispensed.

Further, the present dispenser assists blind persons (and people with low vision) in taking exactly one pill at a time.

BRIEF DESCRIPTION OF THE DRAWINGS

The apparatus will be better understood and objects other than those set forth above will become apparent when consideration is given to the following detailed description thereof. Such description makes reference to the annexed drawings, wherein.

DETAILED DESCRIPTION OF THE EMBODIMENTS

Figure 1:
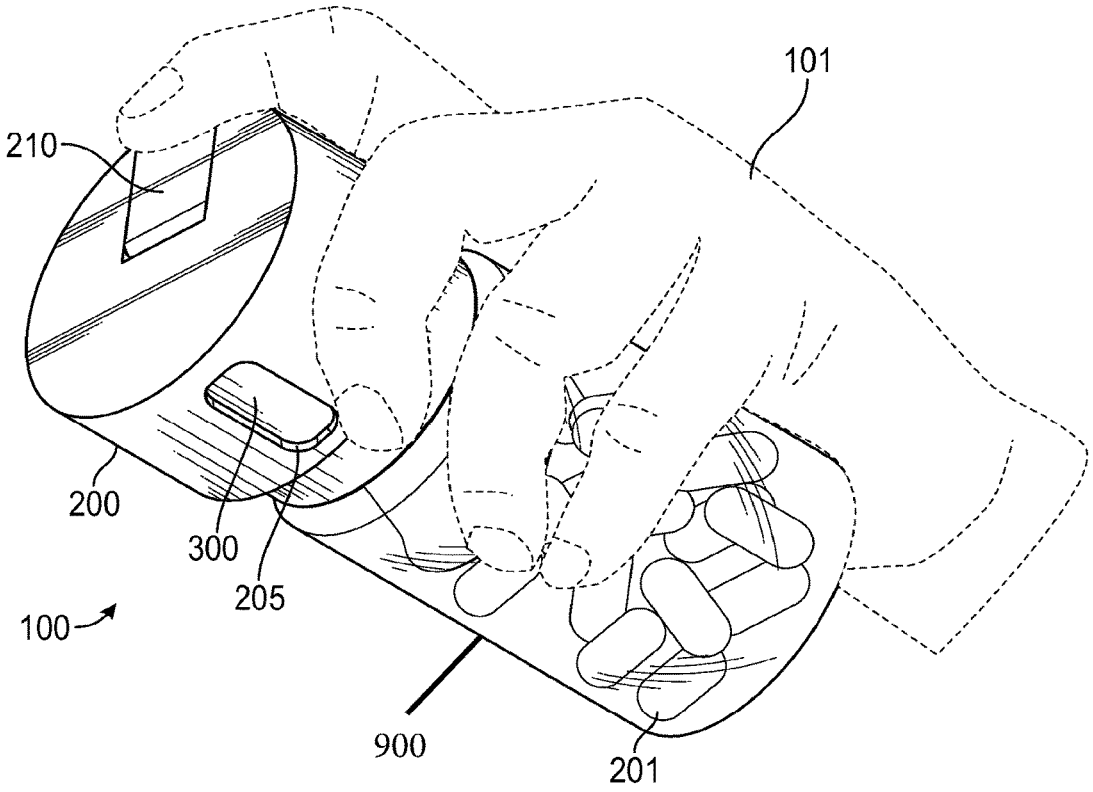
FIG. 1 is a view of the present dispenser in the undepressed position.

The present invention is a push operated pill, tablet, capsule, or other object dispenser 100 that dispenses a single object 201 at the push of a button. As presented herein, the object used in the description is a pill however similar objects such as pills, tablets, caplet, gel caps, pellets, lozenges, pastilles, candy, salts, food items, or other items having a physically compatible form may be dispensed by the dispenser 100.

As shown in at least FIGS. 1-38, the dispenser 100 for dispensing a single pill 201 is comprised of a top lid 200 having a dispensing port 205 and a movable push button 210, and a slider 300 rotatably positioned within the top lid 200.

The slider 300 further including at least one slider slot 310 extending through the body of the slider 300.

The dispenser 100 is optionally attachable to a pill container 900. The dispenser works on existing round mouth pill bottles of different sizes without requiring the use of a special bottle or container.

The dispenser 100 can be operated via single-handed operation or using supplemental devices (not shown) such as a stick or pencil.

The overall operation of the dispenser 100 is provided at least in FIGS. 1-4.

Figure 5:
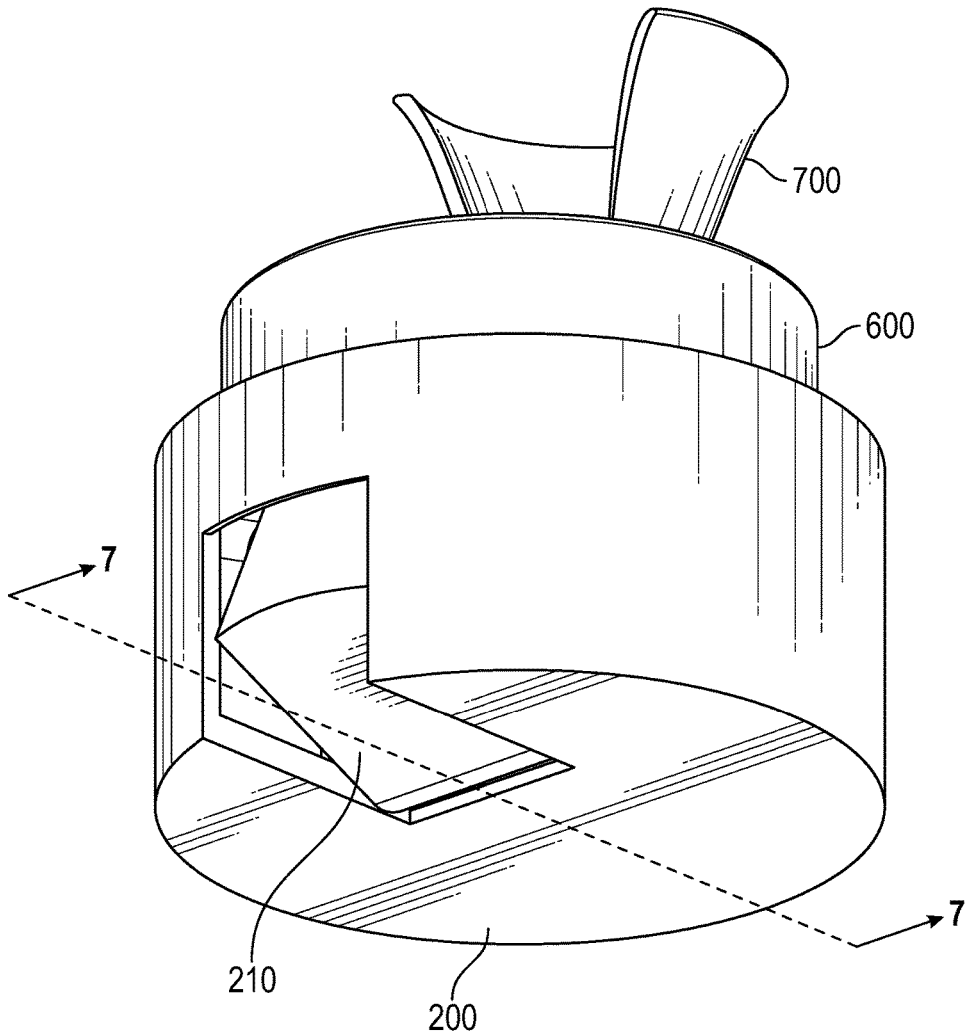
FIG. 5 is a perspective view of the present dispenser.
Figure 6:
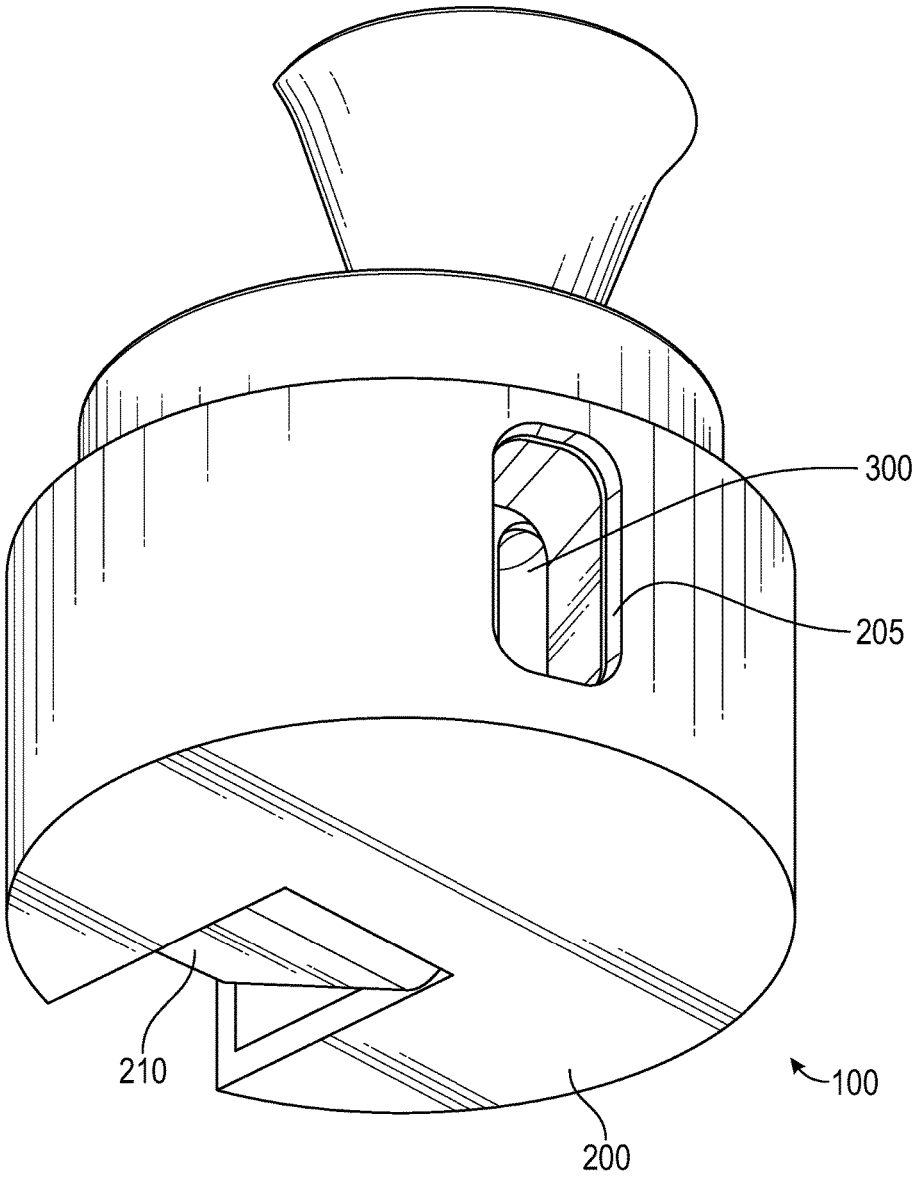
FIG. 6 is a perspective view of the present dispenser.
Figure 7:
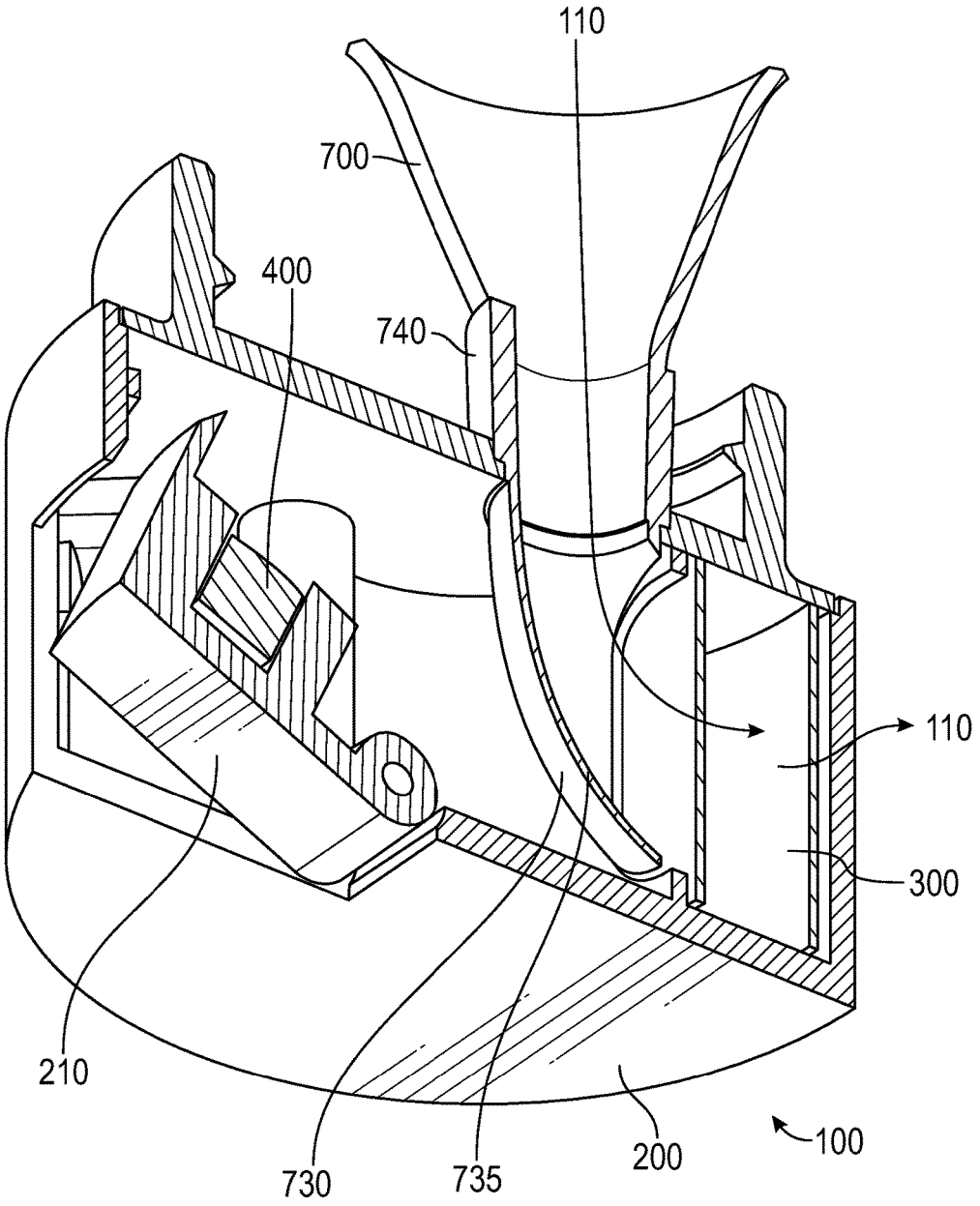
FIG. 7 is a cut away view of the present dispenser along axis 7 of FIG. 5.
Figure 8:
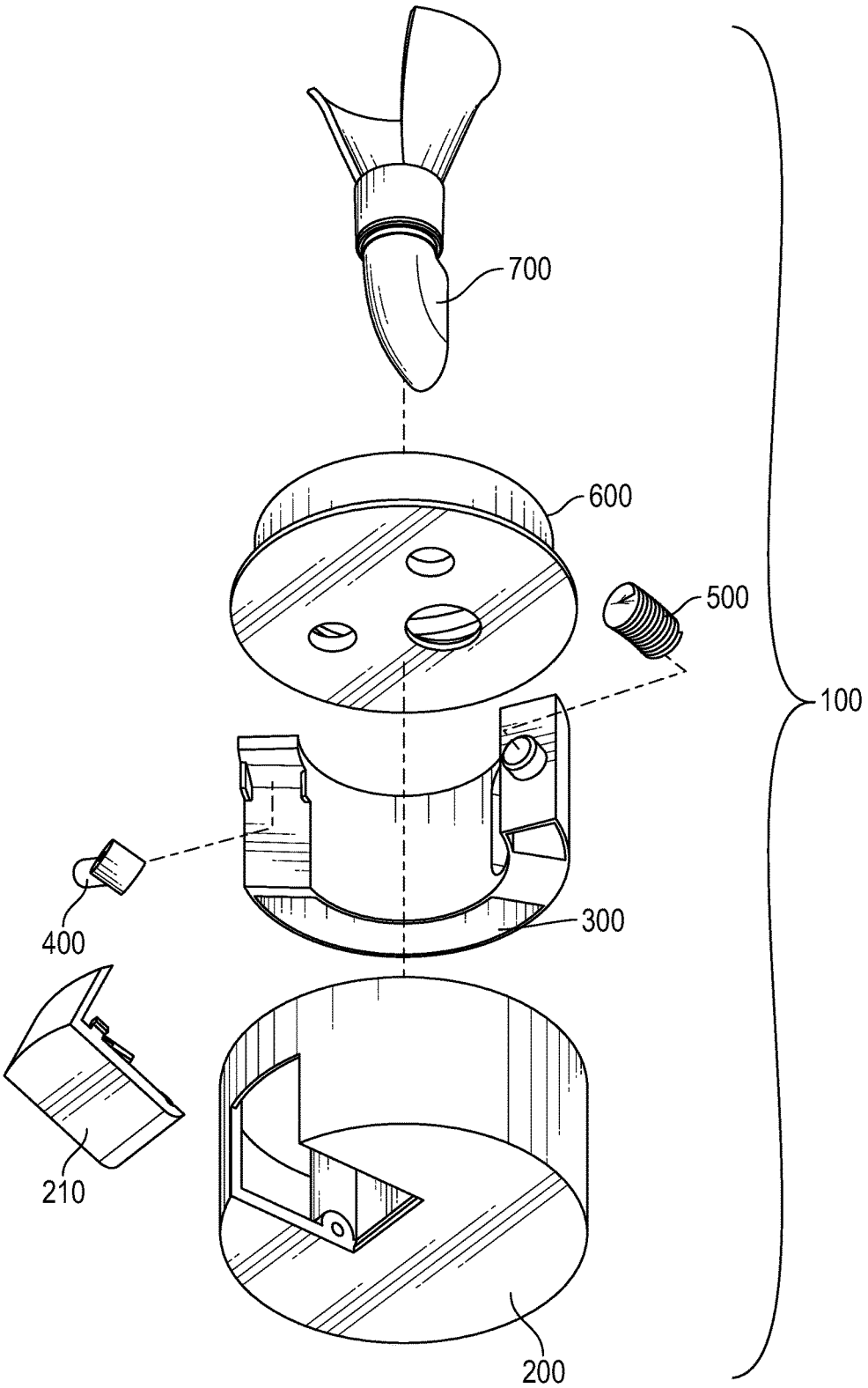
FIG. 8 is an exploded view of the present dispenser.

As shown in FIGS. 5-7, the top lid 200 allows for rotation of the movable push button 210 to adjust the alignment of the rotating slider 300 with respect to the dispensing port 205.

The dispenser 100 further comprises a funnel 700 extending through an opening 610 in bottom lid 600, wherein the bottom lid 600 supports the slider 300. The funnel 700 includes an entrance port 710 at a distal end and an exit port 720 at a proximal. The funnel entrance port 710 and exit port 720 form a portion of a dispensing path 110 (see FIG. 7).

The dispensing path 110 further extends through the slider slot 310 and through the dispensing port 205 of the top lid 200.

Figure 11:
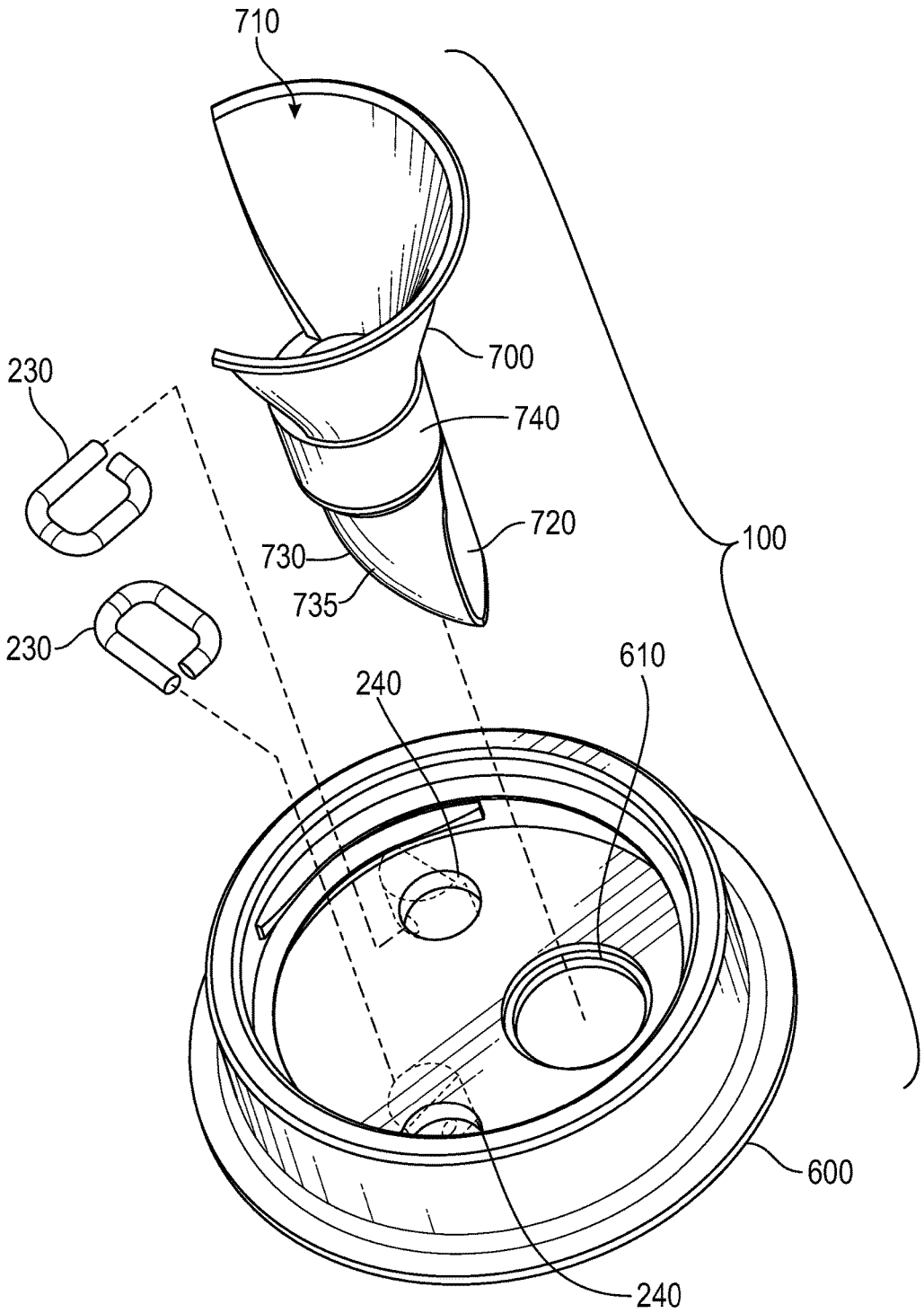
FIG. 11 is an exploded view of the bottom of the present dispenser.
Figure 12:
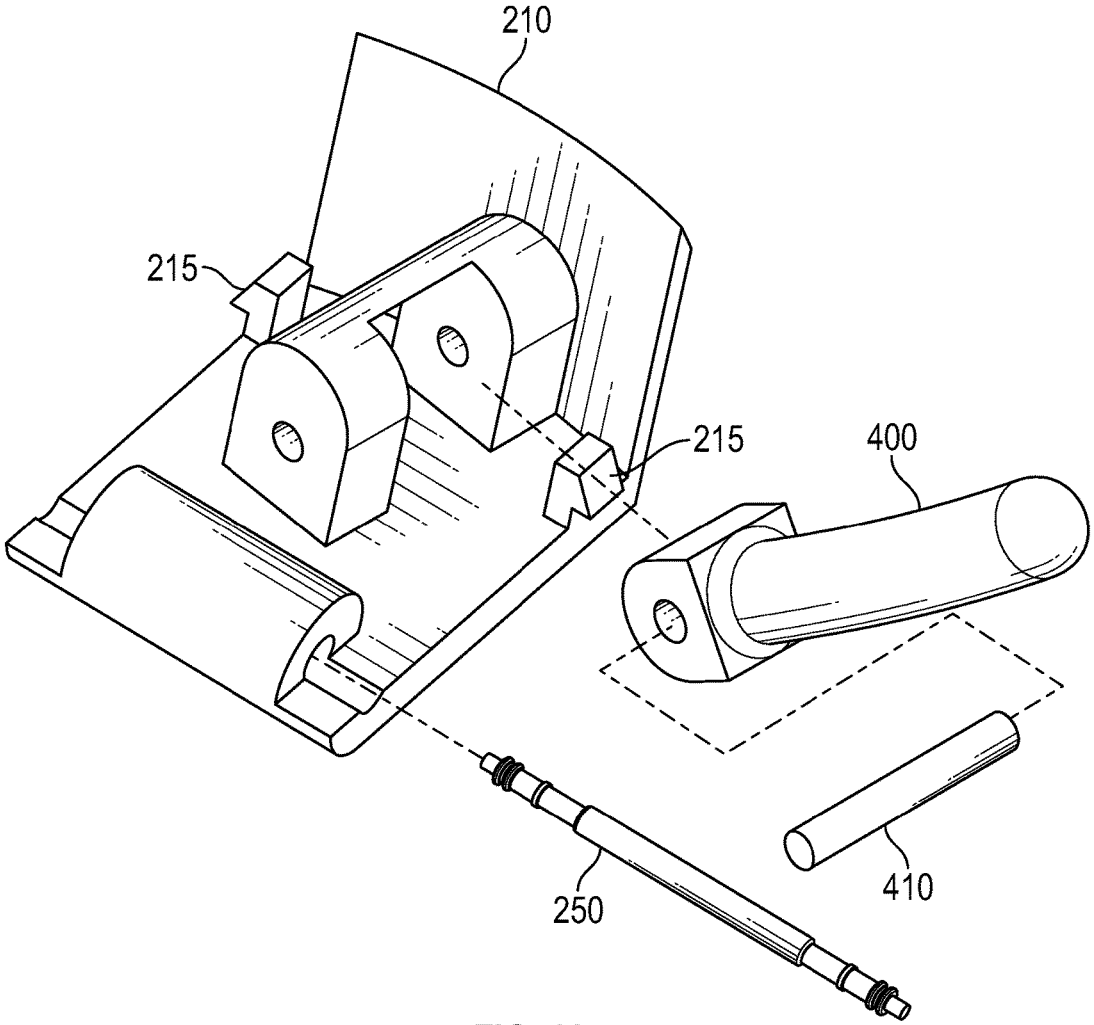
FIG. 12 is an exploded view of actuation elements of the present dispenser.

As shown in FIG. 11, the funnel entrance port 710 is removably or permanently attached to a funnel neck 740 which is attached to a funnel seat 730 which is adjacent to the funnel exit port 720 at the proximal end of the funnel 700.

The funnel entrance port 710, while shown as a partial horn shaped funnel, may be formed in various shapes including a fully round horn shape, a rectangular shape, taller, shorter, as well as formed in various thicknesses.

The funnel neck 740 while shown as having a round shape, may be formed in various shapes including a rectangular shape, triangular shape, taller, shorter, as well as formed in various thicknesses.

The funnel exit port 720 may be formed in various shapes including a rectangular shape, triangular shape, taller, shorter, as well as formed in various thicknesses.

Further the combination of the shapes of the funnel entrance port 710, the funnel neck 740, and funnel seat 730 cooperate to position a single object (such as a pill) at the funnel exit port 720.

For example the inner diameter of the funnel neck 740 may be sized to only allow objects of a selected diameter (or range of selected diameters) to pass through the funnel neck 740 in a single file arrangement.

Further, within the funnel seat 730, the bottom 735 is angled to urge pills 201 towards the funnel exit with minimal pill congestion as it moves along the dispensing path 110. For example, the steeper the interior angle of the funnel seat bottom 735, the less pill congestion there is because pills 201 abut the funnel seat bottom 735 angularly.

In contrast, the flatter the funnel seat bottom 735 within the funnel seat 730, the more there is pill congestion as pills move along the dispensing path 110 because when a pill 201 abuts the funnel seat bottom 735 perpendicularly it resists changing direction to exit the funnel exit port 720. The next pill 201 in a series of pills moving along the dispensing path 110 abuts the pill 201 perpendicularly at the funnel seat bottom 735 and pill congestion occurs.

The height, width, thickness, and shape features selected for the funnel seat bottom 735 and the funnel exit port 720 corresponds to the optimum dimensions for the size of the selected pills 201 which will exit the funnel exit port 720 where the optimum dimensions are dimensions which help minimize pill congestion and helps position a single object (such as a pill) at the funnel exit port 720.

The height, width, thickness, and shape features selected for slider 300 corresponds to the optimum dimensions for the size of the selected pills 201 which will exit the funnel exit port 720 where the optimum dimensions are dimensions which help minimize pill congestion and helps position a single object (such as a pill) at the funnel exit port 720. For example, where the funnel exit port 720 is elongated or circular to respectively accommodate oblong or circular pills, the dimensions (such as height, width, thickness, and shape features) of the slider 300 is appropriately shaped to accommodate respective pills.

In the non-use position, as indicated in FIG. 1, the movable push button 210 is undepressed, funnel exit port 720 is blocked, and the contents within the funnel 700 are unable enter the slider slot 310 of the slider 300.

Further, in the non-use position with the movable push button 210 undepressed, the dispensing port 205 of the top lid 200 is blocked, and contents within the slider slot 310 are unable to exit the dispenser 100.

More particularly, when the push button 210 is undepressed, spring 500 urges the slider 300 to rotate in a first rotation direction and dispensing port 205 of the top is not aligned with slider slot 310 nor the funnel exit port 720 and therefore a pill within the funnel seat 730 of the funnel or the slider slot(s) 310 of the slider 300 cannot exit the dispenser 100.

When the push button 210 is depressed, push lever 400 urges the slider 300 to rotate in a second rotation direction opposite the first rotation direction.

Figure 2:
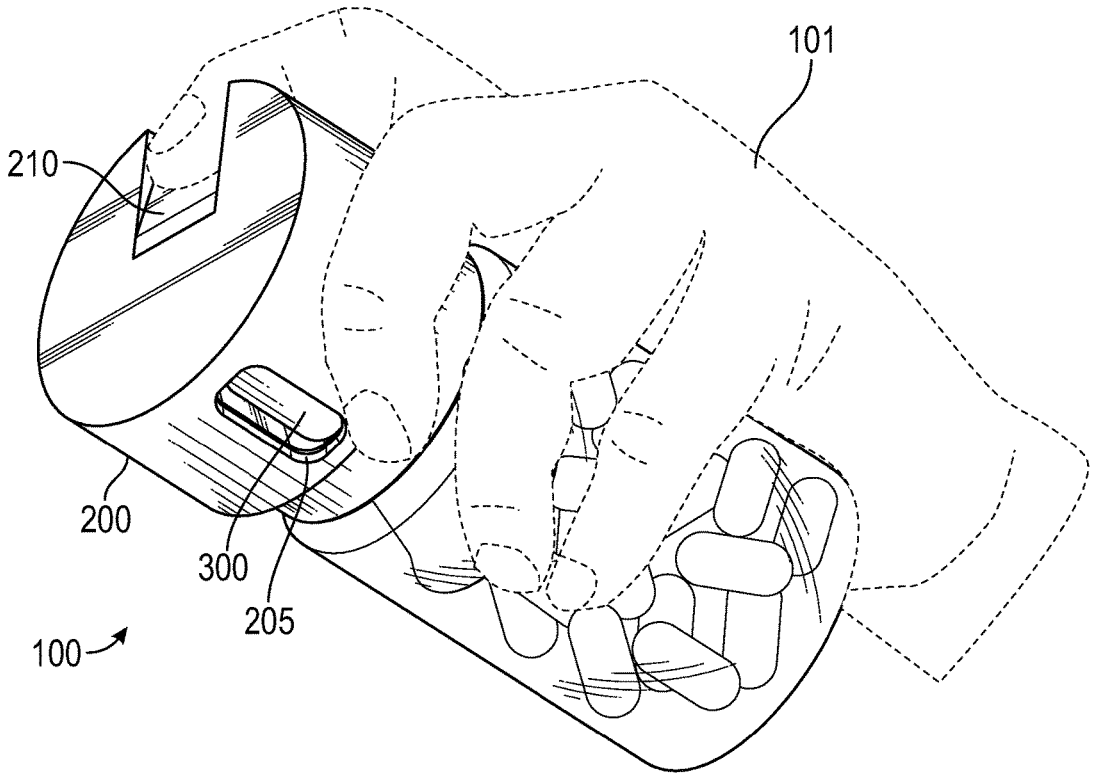
FIG. 2 is a view of the present dispenser in the partially pressed position.
Figure 3:
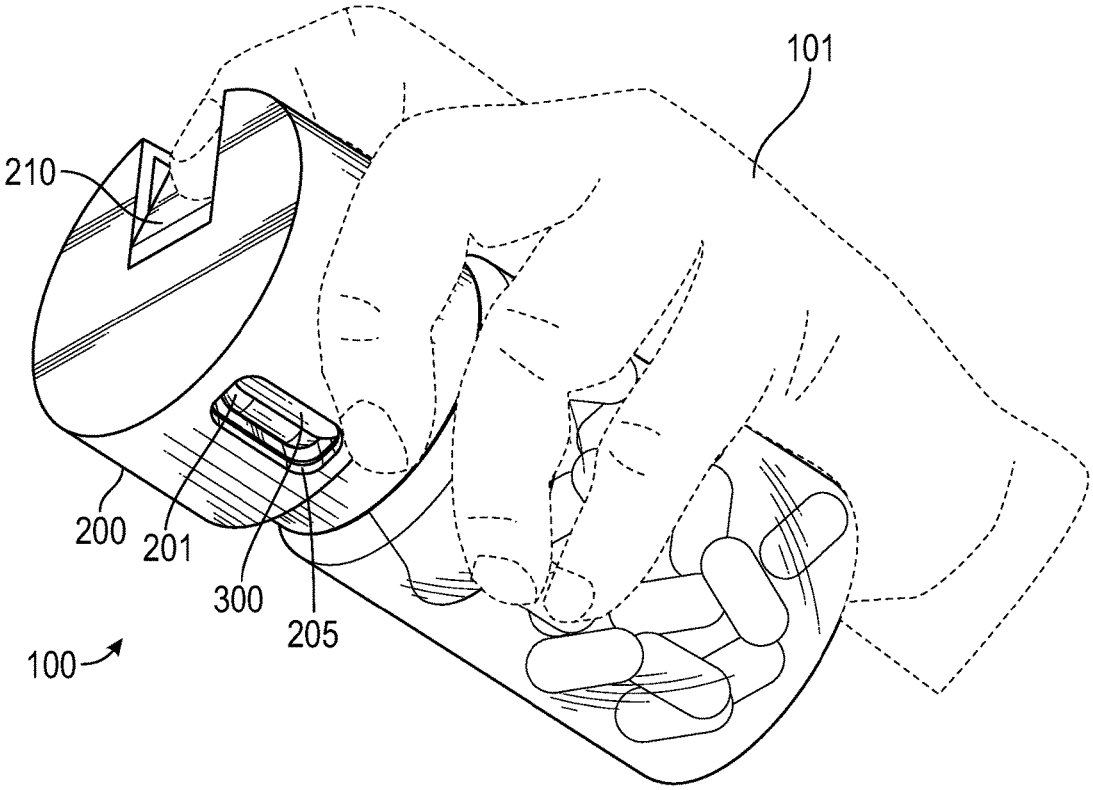
FIG. 3 is a view of the present dispenser in the partially pressed position.
Figure 4:
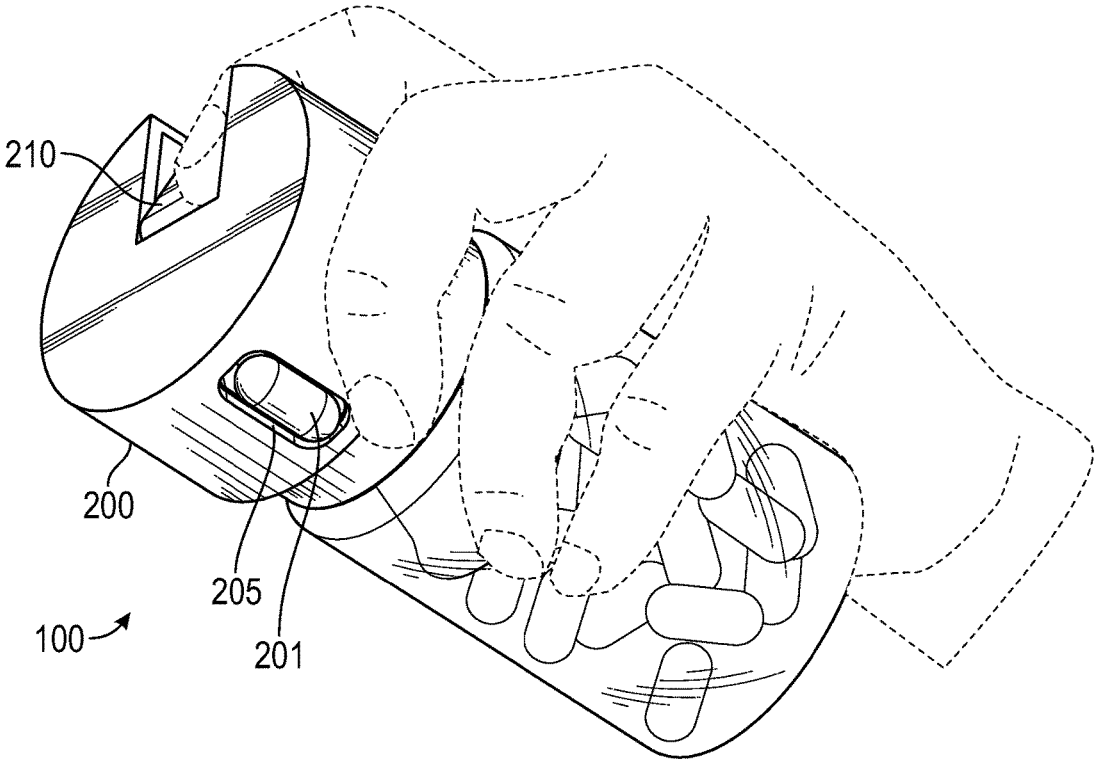
FIG. 4 is a view of the present dispenser in the fully pressed position.

During use of the dispenser 100, as shown in FIGS. 2-4, the user (see hand 101) depresses the moveable push button 210, which causes rotation of the slider 300. When the slider 300 rotates an appropriate amount, the dispensing port 205 is unblocked and the contents (for example pill 201) of the slider slot(s) 310 of the slider 300 and/or the funnel exit port 720 can exit the dispenser 100.

Typically, the user tilts the dispenser 100 while depressing the moveable push button 210 to leverage the use of gravity in urging the pill 201 to exit the dispenser 100. As shown in at least FIGS. 5-8, during use of the dispenser 100, the funnel 700 is positioned with the funnel entrance port 710 higher than the funnel exit port 720 to utilize gravity to assist in feeding objects into the dispensing path 110 of the dispenser 100.

The dispenser 100 further includes push lever 400 moveably linking together the push button 210 and the slider 300. When the push button 210 is depressed, the push lever 400 urges the slider 300 to rotate relative to the amount of depression of the push button 210.

Once the user 101 releases pressure on the movable push button 210, the slider 300 automatically returns to the non-use position shown in FIG. 1 through the assistance of spring 500 and contents of the dispenser 100 are once again blocked from exiting the dispenser 100.

Pin 250 pivotally attaches push button 210 to top lid 200.

Rod 410 pivotally attaches push lever 400 to push button 210.

At least one lock tab 215 is provided on the push button 210 to assist in securing push button 210 to top lid 200 when push button 210 is not depressed.

At least one securing post 220 extends from the interior of top lid 200 and thru at least one securing hole 240 provided on the bottom lid 600.

Figure 9:
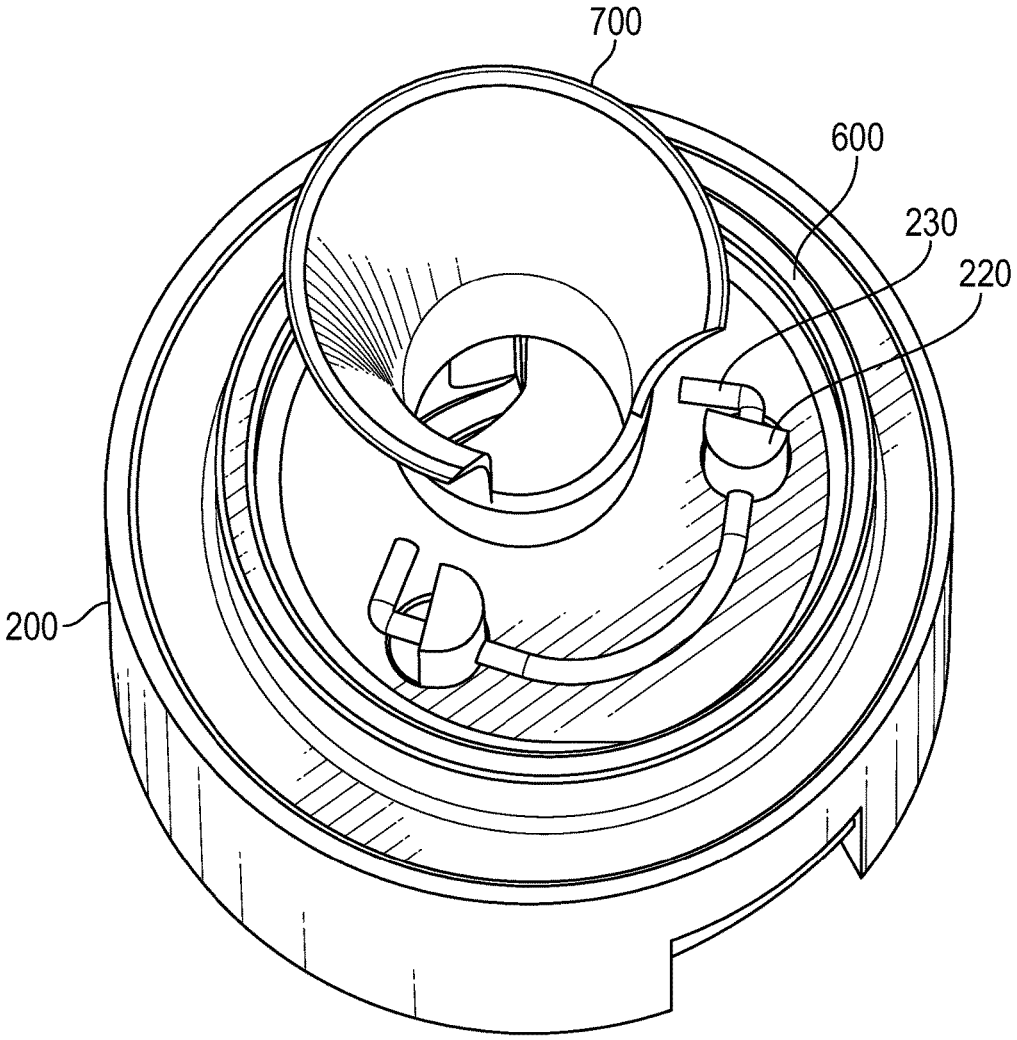
FIG. 9 is a view of the bottom of the present dispenser.
Figure 10:
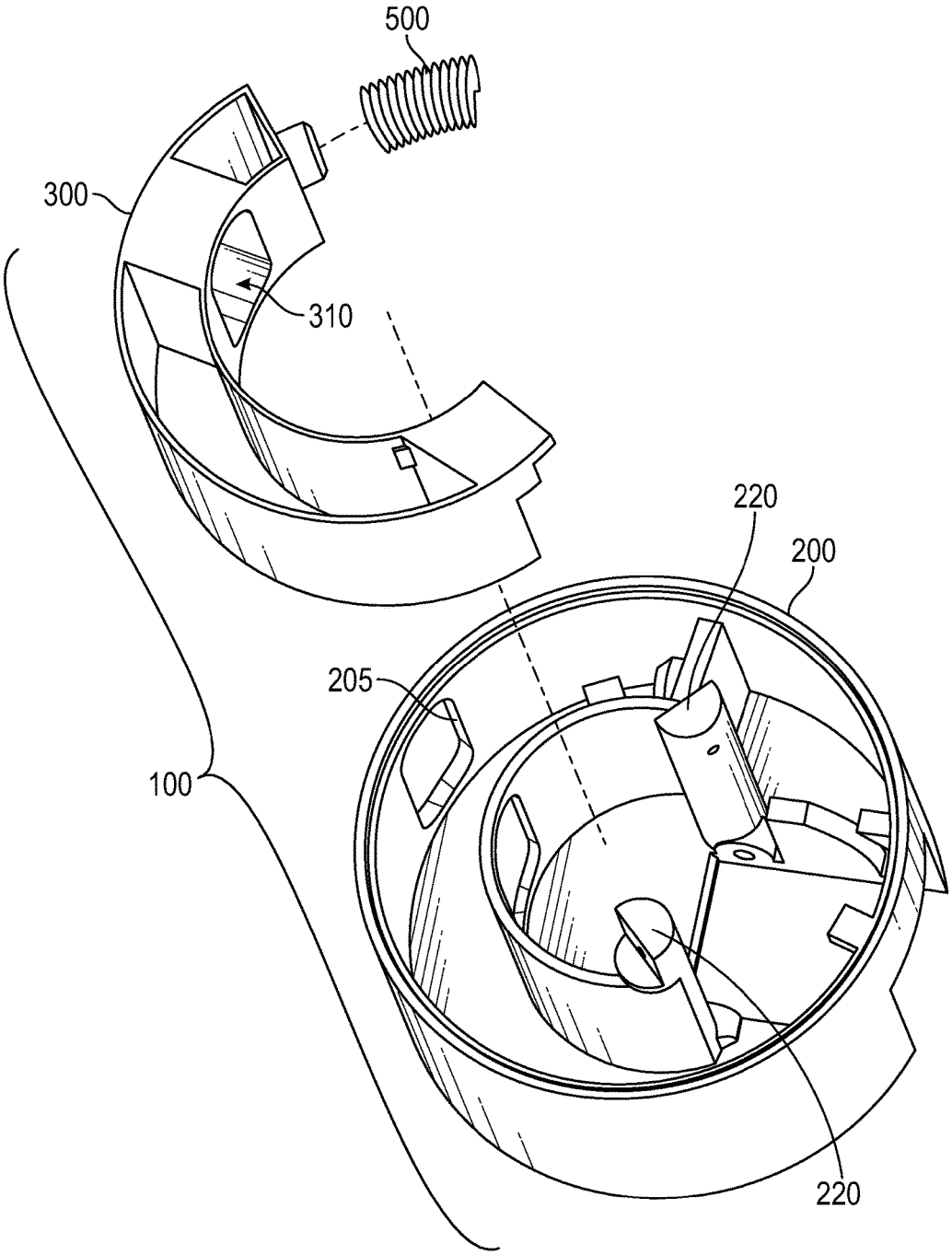
FIG. 10 is an interior view of the present dispenser.

As shown in FIGS. 9-10, at least one securing pin 230 extends thorough at least one securing post 220 to hold the top lid 200 and the bottom lid 600 together.

The dispenser 100 can be manufactured in different colors to provide for quick bottle and/or pill recognition. The dispenser 100 can be manufactured from a range of materials including and not limited to plastic, metals, paper, wood, recycled materials, and biodegradable materials.

The dispenser 100 may include braille touch patterns (not shown) of raised dots for blind persons or persons with low vision to aid in selecting the desired pill bottle so the users takes the appropriate pills. The dispenser 100 may include indicia (not shown) to provide information such as a description of the pill contents or information relevant to the user (such as name).

Other novel features which are characteristic of the apparatus, as to organization and method of operation, together with further objects and advantages thereof can be discerned from the above description considered in connection with the accompanying figures, in which preferred embodiments of the apparatus are illustrated by way of example. It is to be expressly understood, however, that the figures are for illustration and description only and is not intended as a finite definition of the apparatus. The various features of novelty which characterize the apparatus are pointed out with particularity in the claims annexed to and forming part of this disclosure. The apparatus resides not in any one of these features taken alone, but rather in the particular combination of all of its structures for the functions specified.

There has thus been broadly outlined the more important features of the apparatus in order that the detailed description thereof that follows may be better understood, and in order that the present contribution to the art may be better appreciated. Those skilled in the art will appreciate that the conception upon which this disclosure is based readily may be utilized as a basis for the designing of other structures, methods and systems for carrying out the several purposes of the present apparatus. It is important, therefore, that the claims be regarded as including such equivalent constructions insofar as they do not depart from the spirit and scope of the present apparatus.

The foregoing disclosure is sufficient to enable one having skill in the art to practice the apparatus without undue experimentation, and provides the best mode of practicing the apparatus presently contemplated by the inventor. While there is provided herein a full and complete disclosure of the preferred embodiments of this apparatus, it is not intended to limit the apparatus to the exact construction, dimensional relationships, and operation shown and described. Various modifications, alternative constructions, changes and equivalents will readily occur to those skilled in the art and may be employed, as suitable, without departing from the true spirit and scope of the apparatus. Such changes might involve alternative materials, components, structural arrangements, sizes, shapes, forms, functions, operational features or the like. Elements of the instant apparatus may be made from a variety of known materials including wood, rubber, metal, or plastic, as well as from any suitable combination of appropriate materials.

Accordingly, the proper scope of the present apparatus should be determined only by the broadest interpretation of the appended claims so as to encompass all such modifications as well as all relationships equivalent to those illustrated in the drawings and described in the specification.

What is claimed is:

1. A push operated single pill dispenser for dispensing a single pill (201) comprising:

a top lid (200) having a dispensing port (205), and a movable push button (210);

a slider (300) rotatably positioned within the top lid;

a push lever (400) moveably linking together the push button and the slider;

a spring (500) connected between the top lid and the slider;

a bottom lid (600) positioned adjacent to the slider;

a funnel (700) extending through the bottom lid, wherein when the push button is undepressed, the spring urges the slider to rotate in a first rotation direction, and wherein when the push button is depressed, the push lever urges the slider to rotate in a second rotation direction opposite the first rotation direction.

2. The dispenser of claim 1, further comprising:

an entrance port (710) at a proximal end of the funnel and an exit port (720) at a distal end of the funnel;

a slot (310) extending through the slider;

wherein operating the push button rotates the slider and allows the user to align a travel path (800) which extends from the funnel entrance port, through the funnel exit port, and through the slider slot.

3. The dispenser of claim 1, further comprising:

a container connected to the top lid.

4. The dispenser of claim 2, further comprising:

a funnel seat (730) sized to contain a single pill at the distal end of the funnel, wherein when the pill is positioned in the funnel seat, operating the push button to form the travel path allows the pill to travel from the funnel seat, through the slider slot, and exit the dispenser.

5. The dispenser of claim 4, further comprising:

wherein when the push button is not operated or undepressed, the spring urges the slider to rotate in the first rotation direction and a portion of the slider blocks the pill from exiting the dispenser.

6. The dispenser of claim 5, further comprising:

a container connected to the top lid.

7. The dispenser of claim 5, further comprising:

wherein in the slider slot is sized to allow the passage of the single pill.

8. The dispenser of claim 5, further comprising:

wherein in the slider slot is sized to allow the passage of the single object.

9. A push operated single pill dispenser for dispensing a single pill comprising:

a top lid (200) having a movable push button (210);

a slider (300) rotatably positioned within the top lid;

a push lever (400) moveably linking together the push button and the slider;

a spring (500) connected between the top lid and the slider;

a bottom lid (600) positioned adjacent to the slider;

a funnel (700) extending through the bottom lid;

an entrance port (710) at a proximal end of the funnel and an exit port (720) at a distal end of the funnel;

a slot (310) extending through the slider, wherein operating the push button rotates the slider and allows the user to align a travel path (800) which extends from the funnel entrance port, through the funnel exit port, and through the slider slot, wherein when the push button is undepressed, the spring urges the slider to rotate in a first rotation direction, wherein when the push button is depressed, the push lever urges the slider to rotate in a second rotation direction opposite the first rotation direction.

10. The dispenser of claim 9, further comprising:

a funnel seat (730) sized to contain a single pill at the distal end of the funnel, wherein when the pill is positioned in the funnel seat, operating the push button to form the travel path allows the pill to travel from the funnel seat, through the slider slot, and exit the dispenser.

11. The dispenser of claim 10, further comprising:

wherein when the push button is not operated or undepressed, the spring urges the slider to rotate in the first rotation direction and a portion of the slider blocks the pill from exiting the dispenser.

12. A push operated single object dispenser for dispensing a single object comprising:

a top lid (200) having a movable push button (210);

a slider (300) rotatably positioned within the top lid;

a push lever (400) moveably linking together the push button and the slider;

a spring (500) connected between the top lid and the slider;

a bottom lid (600) positioned adjacent to the slider;

a funnel (700) extending through the bottom lid;

an entrance port (710) at a proximal end of the funnel and an exit port (720) at a distal end of the funnel;

a slot (310) extending through the slider, a funnel seat (730) sized to contain a single object at the distal end of the funnel, wherein operating the push button rotates the slider and allows the user to align a travel path (800) which extends from the funnel entrance port, through the funnel exit port, and through the slider slot, wherein when the push button is undepressed, the spring urges the slider to rotate in a first rotation direction, wherein when the push button is depressed, the push lever urges the slider to rotate in a second rotation direction opposite the first rotation direction, wherein when the object is positioned in the funnel seat, operating the push button to form the travel path allows the object to travel from the funnel seat, through the slider slot, and exit the dispenser, and wherein when the push button is not operated or undepressed, the spring urges the slider to rotate in the first rotation direction and a portion of the slider blocks the object from exiting the dispenser.

* * * * *